US009315021B2

(12) United States Patent
Nystrom et al.

(10) Patent No.: US 9,315,021 B2
(45) Date of Patent: Apr. 19, 2016

(54) MULTIPLE THIN FILM PIEZOELECTRIC ELEMENTS DRIVING SINGLE JET EJECTION SYSTEM

(71) Applicant: Xerox Corporation, Norwalk, CT (US)

(72) Inventors: Peter J. Nystrom, Webster, NY (US); Barry P. Mandel, Fairport, NY (US); Peter M. Gulvin, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/192,113

(22) Filed: Feb. 27, 2014

(65) Prior Publication Data

US 2015/0239246 A1 Aug. 27, 2015

(51) Int. Cl.
*B41J 2/045* (2006.01)
*B41J 2/14* (2006.01)

(52) U.S. Cl.
CPC .... *B41J 2/14233* (2013.01); *B41J 2002/14338* (2013.01); *B41J 2002/14403* (2013.01)

(58) Field of Classification Search
CPC ..... B41J 2/14201; B41J 2/14233; B41J 2002/14241; B41J 2/14274; B41J 2002/14306; B41J 2/161; B41J 2/1612
USPC ..... 347/70, 68, 71
See application file for complete search history.

(56) References Cited

U.S. PATENT DOCUMENTS

| | | | | |
|---|---|---|---|---|
| 7,048,361 | B2 | 5/2006 | Schmachtenberg, III et al. | |
| 2006/0244771 | A1 * | 11/2006 | Scardovi | B41J 2/0451 347/10 |
| 2009/0213187 | A1 * | 8/2009 | Kitakami | B41J 2/14233 347/70 |
| 2009/0231373 | A1 * | 9/2009 | Gardner | B41J 2/0459 347/11 |

FOREIGN PATENT DOCUMENTS

WO 2012175593 A1 12/2012

* cited by examiner

*Primary Examiner* — Henok Legesse
(74) *Attorney, Agent, or Firm* — MH2 Technology Law Group, LLP

(57) ABSTRACT

A printhead including a plurality of actuators, wherein each actuator of the plurality of actuators includes a plurality of drive electrodes, a plurality of diaphragms, and a single nozzle. Each drive electrode is uniquely paired with one of the diaphragms. In an embodiment, the printhead may be configured so that all drive electrodes for a single actuator always activate simultaneously to eject ink from the single nozzle. In another embodiment, the printhead may be configured so that each drive electrode of the plurality of drive electrodes for a single actuator are individually addressable and may be fired independently of the other drive electrodes of the single actuator.

20 Claims, 7 Drawing Sheets

MULTIPLE THIN FILM PIEZOELECTRIC ELEMENTS DRIVING SINGLE JET EJECTION SYSTEM

TECHNICAL FIELD

The present teachings relate to the field of ink jet printing devices and, more particularly, to methods and structures for high density ink jet print heads and a printer including a high density ink jet print head.

BACKGROUND

Drop on demand ink jet technology is widely used in the printing industry. Printers using drop on demand ink jet technology can use thermal, electrostatic, or piezoelectric technology.

Piezoelectric ink jet print heads include an array of piezoelectric elements (i.e., transducers, PZTs, or actuators) overlying an ink-filled body chamber. Piezoelectric ink jet print heads can typically further include a flexible diaphragm or membrane to which the array of piezoelectric elements is attached. When a voltage is applied to a piezoelectric element, typically through electrical connection with a top electrode electrically coupled to a power source, the piezoelectric element bends or deflects, causing the diaphragm to flex which expels a quantity of ink from a chamber through a nozzle or jet. The flexing further draws ink into the chamber from a main ink reservoir through an opening to replace the expelled ink.

In electrostatic ejection, each electrostatic actuator, which is formed on a substrate assembly, typically includes a flexible diaphragm or membrane, an ink-filled ink chamber between the aperture plate and the membrane, and an air-filled air chamber between the actuator membrane and the substrate assembly. An electrostatic actuator further includes an actuator top electrode formed on the substrate assembly. When a voltage is applied to activate the actuator top electrode, the membrane is drawn toward the top electrode by an electric field and actuates from a relaxed state to a flexed state, which increases a volume of the ink chamber and draws ink into the ink chamber from an ink supply or reservoir. When the voltage is removed to deactivate the actuator top electrode, the membrane relaxes, the volume within the ink chamber decreases, and ink is ejected from the nozzle in the aperture plate.

Some printheads include the use of a bulk piezoelectric material that is from 2 to 4 mils (50 to 100 μm) thick and a stainless steel diaphragm that is 20 microns or more in thickness. The diaphragm of these printheads overlies a body chamber that may be square or trapezoidal in shape, where the body chamber has chamber dimensions on the order of 400 to 800 microns per side. These systems typically have low aspect ratio body chambers where the ratio of the length to the width is between 1.0 and 1.5. Other thin film piezoelectric systems include the use of a much thinner diaphragm, on the order of between 1.0 and 5.0 microns thick, or between 1.0 and 3.0 microns thick. Because of the increased flexibility of this thinner diaphragm material, the body chambers of thin film piezoelectric systems may be designed to be a long, thin rectangular shape with a high aspect ratio to control the vibrational modes of the diaphragm that overlies the body chamber. For example, each body chamber may be less than 100 microns wide and more than 600 microns long. These designs may incorporate a top electrode over each body chamber that is similarly long and thin. The top electrode is separated from a bottom electrode by the thin film piezoelectric material.

Forming a square or trapezoidal body chamber using a thin diaphragm material would result in a diaphragm that deflects with excessive amplitude or has undesirable vibrational modes during ejection of ink from the nozzle, and the jetting of ink would not be easily controlled. Thin film devices that use a high aspect ratio body chamber typically have arrays of very closely spaced nozzles. When the nozzles are very closely spaced the fluid path is often constructed using a silicon structure and microfabrication methods that can be cost effective in very large build volumes, but are not very cost effective in lower build volumes. A thin-film piezoelectric driver system that can be used in a high density printhead design with a nozzle spacing that enables lower cost manufacturing methods would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

An embodiment may include a plurality of actuator systems, wherein each actuator system includes a plurality of spaced drive electrodes, a plurality of diaphragms, wherein each drive electrode of the plurality of spaced drive electrodes is uniquely paired with one diaphragm of the plurality of diaphragms, a body chamber partially defined by the plurality of diaphragms and a plurality of nodes within the body chamber that physically contact the plurality of diaphragms, wherein the body chamber is configured to be filled with ink during printing, and a nozzle, wherein each of the plurality of diaphragms is configured to eject ink through the nozzle.

Another embodiment may include a printer having at least one printhead including a plurality of actuator systems, wherein each actuator system includes a plurality of spaced drive electrodes, a plurality of diaphragms, wherein each drive electrode of the plurality of spaced drive electrodes is uniquely paired with one diaphragm of the plurality of diaphragms, a body chamber partially defined by the plurality of diaphragms and a plurality of nodes within the body chamber that physically contact the plurality of diaphragms, wherein the body chamber is configured to be filled with ink during printing, and a nozzle, wherein each of the plurality of diaphragms is configured to eject ink through the nozzle. The printer may further include a printer housing that encases the printhead.

Another embodiment may include a method for printing ink including activating a first drive electrode of a first actuator system that is part of an actuator system array to deflect a first diaphragm that is uniquely paired with the actuator system first drive electrode to eject a first ink drop having at least one of a first volume and a first velocity from a nozzle in an aperture plate, while a second drive electrode of the first actuator system remains deactivated, and activating the second drive electrode of the first actuator system to deflect a second diaphragm that is uniquely paired with the actuator system second drive electrode and simultaneously activating the first drive electrode to eject a second ink drop having at least one of a second volume, a second velocity, and a second directionality from the nozzle in the aperture plate, wherein the at least one of the second volume, the second velocity, and the second directionality is different from the at least one of the first volume, the first velocity, and the first directionality.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

Detailed Description

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, additive manufacturing device (e.g., 3D printer), electrostatographic device, etc.

An embodiment of the present teachings may include the formation of an inkjet actuator array using a thin diaphragm that overlies a body chamber which, during operation, is filled with ink. In an embodiment, the diaphragm may be from 1 micron to 10 microns thick, or may be 1 micron or less in thickness. Each actuator system in the actuator array, and the body chamber for each ejector, may be formed in a square or trapezoidal shape, or another shape, rather than in a long, thin rectangular shape of conventional thin-diaphragm designs. Additionally, each actuator system for each jet may include multiple (two or more) thin-film driver elements (top electrodes, drive electrodes, top plates, or top electrode segments). In an embodiment, each of the multiple top electrode segments for an actuator system may be electrically coupled together so that only one electrical interconnect for the top plate and one electrical interconnect for the bottom plate (bottom electrode), which is common to an array of actuators, is required to individually address each actuator system. In another embodiment, each of the multiple top electrode segments for an actuator system may themselves be individually addressable to enable, for example, the formation of variable ink drop sizes or to vary ink drop velocities from the same jet. Embodiments encompass both piezoelectric actuators and electrostatic actuators.

Figure 1:
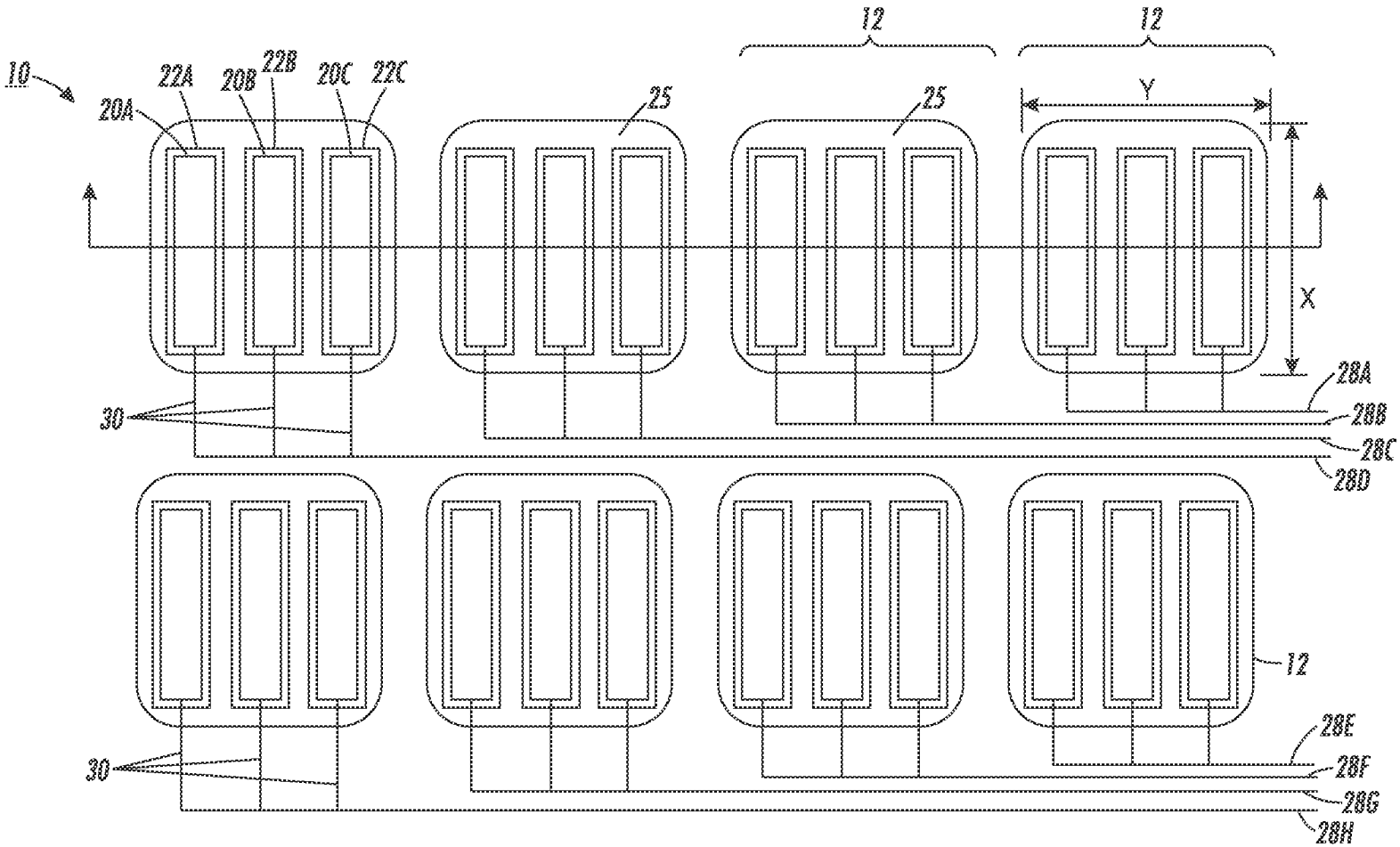
FIG. 1 is a plan view.
Figure 2:
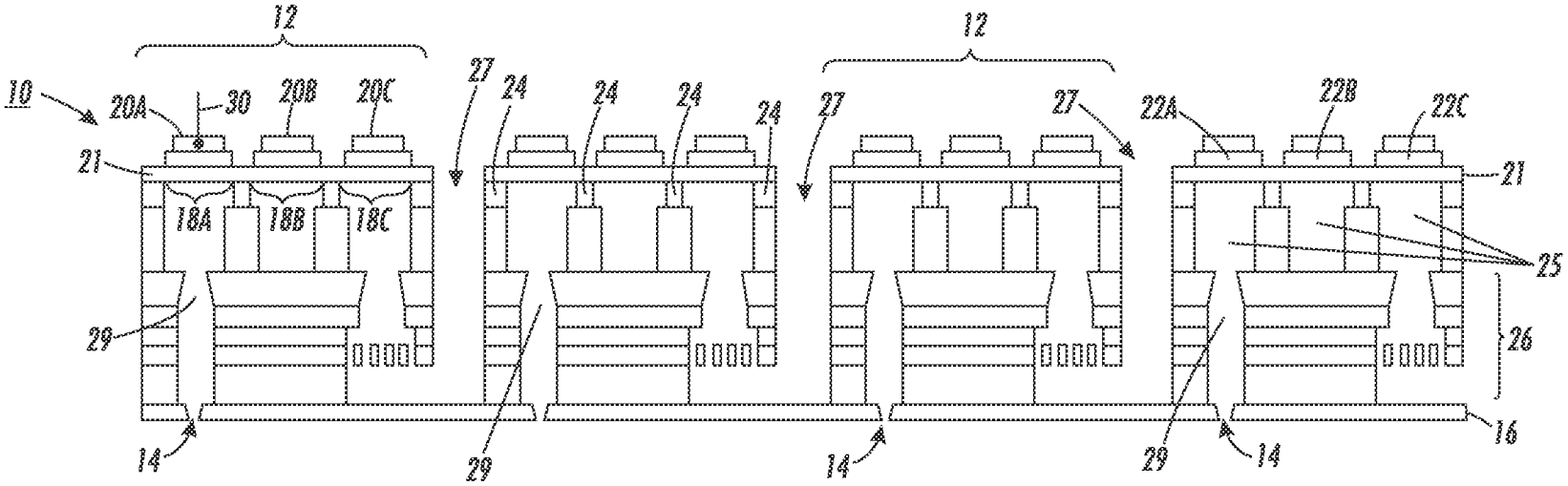
FIG. 2 is a cross section, depicting a portion of a printhead actuator system array in accordance with an embodiment of the present teachings.

FIG. 1 is a schematic plan view, and FIG. 2 is a schematic cross section, depicting a layout of a portion of a piezoelectric actuator layout 10 according to an embodiment of the present teachings. While FIG. 1 depicts eight piezoelectric actuator systems 12 configured to eject ink independently from one of eight nozzles 14 in an aperture plate 16, it will be understood that an actuator array may include hundreds or thousands of actuator systems 12.

Each actuator system 12 may further include two or more diaphragms 18A-18C, two or more spaced top electrode portions 20A-20C, and two or more spaced thin film piezoelectric portions 22A-22C. Each top electrode portion 20 may be separated from a paired diaphragm 18 by one of the piezoelectric portions 22 as depicted. Each top electrode portion 20 may be designed to actuate only the diaphragm 18 paired therewith. As depicted in FIG. 2, the diaphragms 18 for a plurality of actuator systems 12 are formed from the same continuous diaphragm layer 21. However, each separate diaphragm 18 is defined, in cross section, by at least a pair of structural nodes (vibration nodes) 24 that physically contact the diaphragms 18 and separate the continuous diaphragm layer 21 into individual, functionally separate diaphragms 18. Additionally, in an embodiment, the structural nodes 24 for an actuator 12 may also at least partly define a body chamber 25 for the actuator 12. The body chamber 25 may be further defined at least in part by the diaphragm layer 21.

Individual sections of the body chamber 25 for a single actuator system 12 may be connected at the ends so that each body chamber 25 for a single actuator system 12 provides a continuous ink flow path between an ink inlet 27 and an ink outlet 29, where each ink outlet ends in a single nozzle 14. In this embodiment, a cross section at one or more first locations may appear similar to that depicted in FIG. 2, while a cross section at one or more second locations may appear similar to that depicted in FIG. 6. In this embodiment, the nodes 24 are interposed between, and physically contact, the diaphragm layer 21 and a lower printhead layer or structure as depicted. Further, the plurality of nodes 24 define a plurality of sub-chambers within the body chamber 25 such that each single actuator system includes a plurality of sub-chambers. In this embodiment, the nodes 24 define each diaphragm 18 and also reduce crosstalk on a non-paired diaphragm 18 during firing of one of the top electrodes 20. In other words, where each node 24 is fully supported at the top and bottom along a majority of its length, the diaphragms 18 for a single actuator system are fully decoupled such that firing one of the top electrodes may deflect its paired diaphragm at a full amplitude, but other non-paired diaphragms are not deflected.

Further, the plurality of diaphragms 18 for each single actuator system 12 may be configured to eject ink supplied through a single body chamber 25. During use, the maximum amplitude of vibration of each diaphragm is roughly located at the center of the diaphragm 18 equidistant between its two nodes 24. The nodes 24 may be formed from one or more layers of dielectric material. Having a plurality of openings through the nodes 24 that separates the body chamber 25 into a plurality of sub-chambers may improve the flow of ink between the ink inlet 27 and the ink outlet 29.

As depicted in the FIG. 1 plan view, each body chamber 25 in an actuator system array may have roughly the same length (X-direction) and width (Y-direction) dimensions, or length and width dimensions that differ by no more than 10% from each other. Body chamber 25 shapes may include a generally square shape (0% variation in the length and width dimensions) or a slightly rectangular shape (where the length is up to 2.0 times, or up to 1.5 times, the width dimension or the width is up to 2.0 times, or up to 1.5 times, the length dimension). In other words, the aspect ratio of the body chamber or diaphragm (length/width or width/length) may be between 1.0 and 2.0, or between 1.0 and 1.5.

In an embodiment, the diaphragm layer 21 may be formed from stainless steel, silicon, invar, or other materials and may have a thickness of between about 1 μm and about 15 μm thick, or between about 1 μm and about 10 μm thick, or between about 1 μm and about 3 μm thick. The thin film piezoelectric material may be between about 1 μm and about 20 μm thick, or between about 1 μm and about 10 μm thick, or between about 3 μm and about 10 μm thick. The top electrode portions 20 may be nickel or another conductive material with a thickness that is typically less than about 2.5 μm. In an embodiment, each actuator body chamber may be approximately square or trapezoidal, where the length (X-dimension) and width (Y-dimension, FIG. 1) are both between about 300 μm and about 500 μm and a length of between about 400 μm and 1000 μm. In an embodiment, the top electrode portions 20 may be slightly smaller in size than the piezoelectric material underneath them. Various other printhead structures 26 (e.g., body plate, particulate filters) as depicted, or other non-depicted structures, may be formed in accordance with techniques known in the art. These structures 26 are located between the diaphragm layer 21 and the aperture plate 16. Other printhead structures such as drive electronics, ink feed structures, etc., not individually depicted for simplicity, may overlie the top of the FIG. 2 structure. Additionally, it will be appreciated that the FIGS. are general depictions and that other structures may be added or existing structures may be removed or modified.

For each actuator system 12, FIG. 1 depicts only one control line 28A-28H to all of the top electrodes for a single actuator system 12. In this embodiment, each control line 28 branches into a plurality of interconnects 30, where each interconnect 30 is routed to one of the top electrode portions 20A-20C for the associated actuator system 12. The diaphragm layer 21 functions as a common bottom electrode for the plurality of actuator systems 12 in the actuator system array. During operation of the printhead, one or more of the control lines 28 is activated, which provides a voltage to the plurality of top electrode portions 20 for the activated actuator system. The voltage to the plurality of top electrode portions 20 causes the plurality of spaced piezoelectric layers 22 for the activated actuator system to bend or deflect which, in turn, causes each of the diaphragms 18 for the activated actuator system 12 to bend or deflect. Bending of the diaphragms 18 creates a pressure pulse through the ink within the body chamber 27 that causes ink to be ejected from the nozzle 14 for the activated actuator system 12. Each actuator system 12 is individually addressable to provide drop-on-demand (DOD) printing.

Forming actuator body chambers with larger dimensions and low aspect ratios (e.g., between about 1.0 and about 2.0, or between about 1.0 and about 1.5) in conventional designs of actuators using thin diaphragms (i.e., diaphragms 3 microns or less in thickness, or 1 micron or less in thickness), is not a workable design choice. Because the thinner diaphragm is much less rigid than a thicker diaphragm, it is difficult to control flexing of the thin diaphragm for an actuator in conventional device, and thus a functional actuator with good diaphragm control cannot be formed successfully with a body chamber having a low aspect ratio. As discussed above, body chambers of actuators formed with thin film diaphragms are typically designed with high aspect ratios (long and thin, for example 600 μm long and 70 μm wide, a length/width aspect ratio of more than 8.5).

Figure 3:
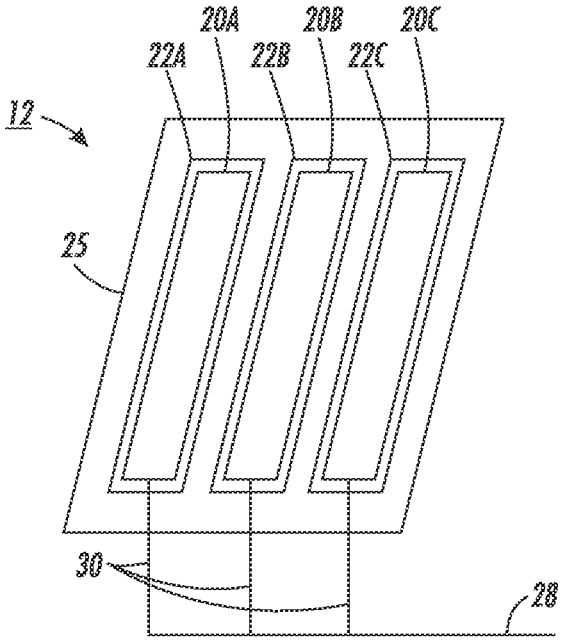
FIGS. 3 and 4 are plan views depicting actuator systems in accordance with embodiments of the present teachings.

In another embodiment as depicted in the plan view of FIG. 3, the body chamber 25 of each piezoelectric actuator system 12 may have a trapezoidal or parallelogram shape. The length and width dimensions of the body chamber 25, and the dimensions of the top electrode portions and the other structures, may be similar to those as described with reference to the embodiment of FIGS. 1 and 2.

In the embodiments described above, activating an actuator causes simultaneous deflection of each of the plurality of diaphragms in the actuator system, as each of the top plates of the activated actuator are electrically connected and activate at the same time. This creates a single pressure pulse through the ink in the body chamber during firing of the actuator, which is the same or similar during every actuating of the actuator with little or no variation. In addition to allowing the formation of low aspect ratio body chambers with thin film diaphragms, activating a plurality of diaphragms to eject ink from a single nozzle during activation of an actuator allows thin film driver technology to be used in high density printhead systems in which the nozzle spacing is relatively large, for example 400 μm or larger. This allows the fluidic path to be constructed using layers of stainless steel or polymers and further allows the fluid path to be built in a range of build volumes for a relatively low cost.

Figure 4:
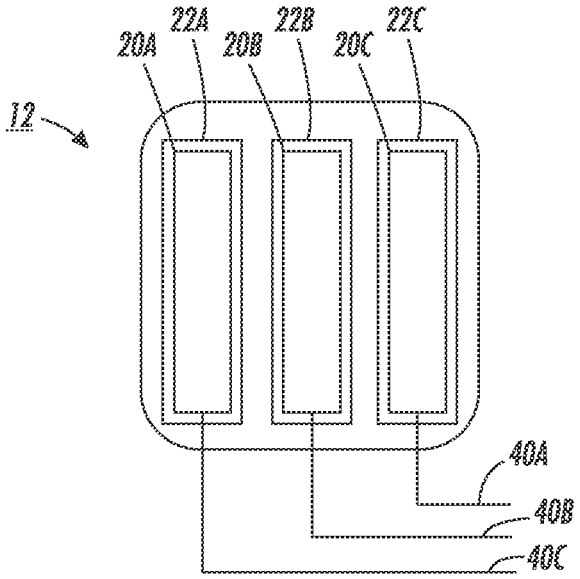

Another piezoelectric actuator system design is depicted in the plan view of FIG. 4. In this embodiment, each top electrode portion 20 of each piezoelectric actuator system 12 is electrically coupled with a separate interconnect 40A-40C, such that each of the plurality of top electrodes 20A, and thus the plurality of diaphragms 18, for a single individually addressable actuator system 12 are themselves individually addressable. This allows each diaphragm 18 of each actuator system 12 to be fired at different times, for example to tune a pressure pulse generated by the plurality of diaphragms for a single actuator system to adjust ink drop size, velocity, directionality, etc. In an embodiment having three individually addressable diaphragms per actuator, activating only one drive electrode to deflect a single diaphragm while another drive electrode remains deactivated may eject a first ink drop having a first ink volume, a first velocity, and/or a first directionality from a nozzle, while simultaneously activating two diaphragms may eject a second ink drop having a second ink volume, a second velocity, and/or a second directionality from the nozzle, each of which is different (i.e., a larger volume, a faster velocity, or a different directionality with a different ejection path) than the first ink drop, and firing three diaphragms may eject a third ink drop having a third ink volume, a third velocity, and/or a third directionality from the nozzle, each of which is different than the first ink drop and the second ink drop.

Further, the electrical characteristics of each signal transmitted to each interconnect 40 can be varied to customize a wave form of a pressure pulse generated by the diaphragm, for example increasing or decreasing the amplitude of diaphragm deflection to further adjust a size or velocity of an ink drop from a nozzle. For example, in a three-diaphragm actuator system, the center diaphragm can be actuated to achieve a smaller pressure pulse and two or more of the diaphragms can be fired simultaneously to produce a larger pulse. This may allow the drop ejection to be tailored for a particular use.

Figure 5:
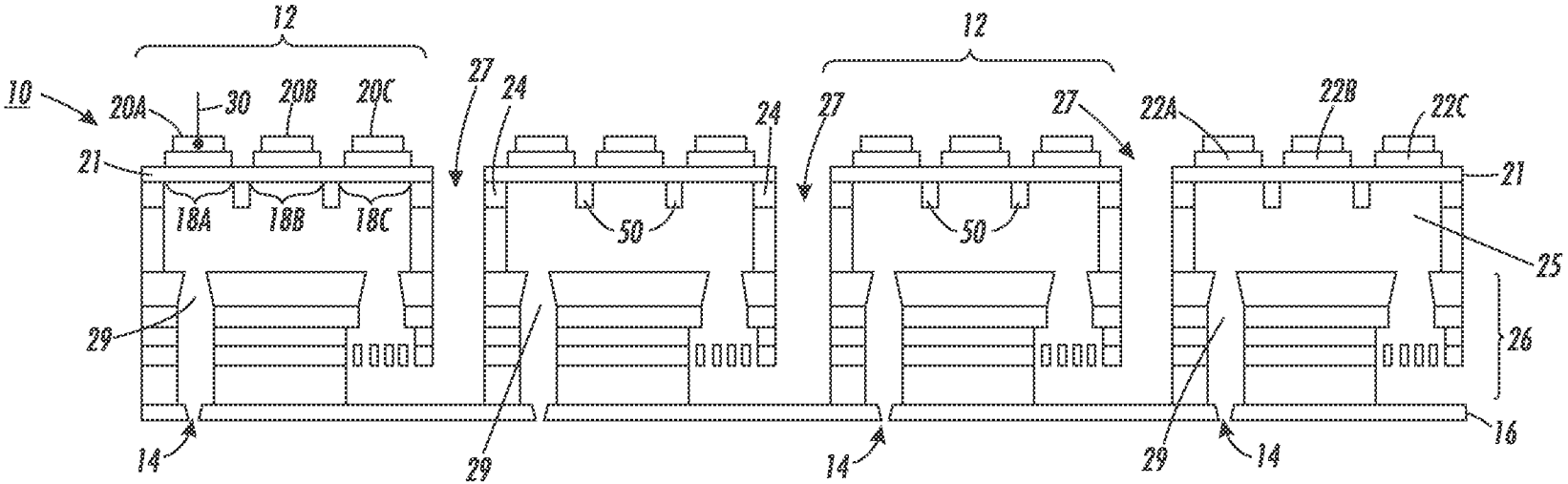
FIGS. 5-7 are cross sections depicting embodiments of actuator systems in accordance with other embodiments of the present teachings.

Other structural implementations are contemplated to form a printhead in accordance with the present teachings. For example, FIG. 5 depicts a piezoelectric actuator system embodiment including diaphragm nodes 50 that hang from the diaphragm layer 21, but are unsupported at the bottom of at least a portion of the nodes 50, and may include other nodes 24 that are supported. This is in contrast to the embodiment of FIG. 2 in which all nodes 24 are all fully supported. Including unsupported nodes opens the body chamber 52, which may improve the flow of ink between the ink inlet 27 and the ink outlet 29, although even the systems with supported nodes may include fluid paths around or through the supports as described above such that the ink can freely flow throughout the common body chamber.

Figure 6:
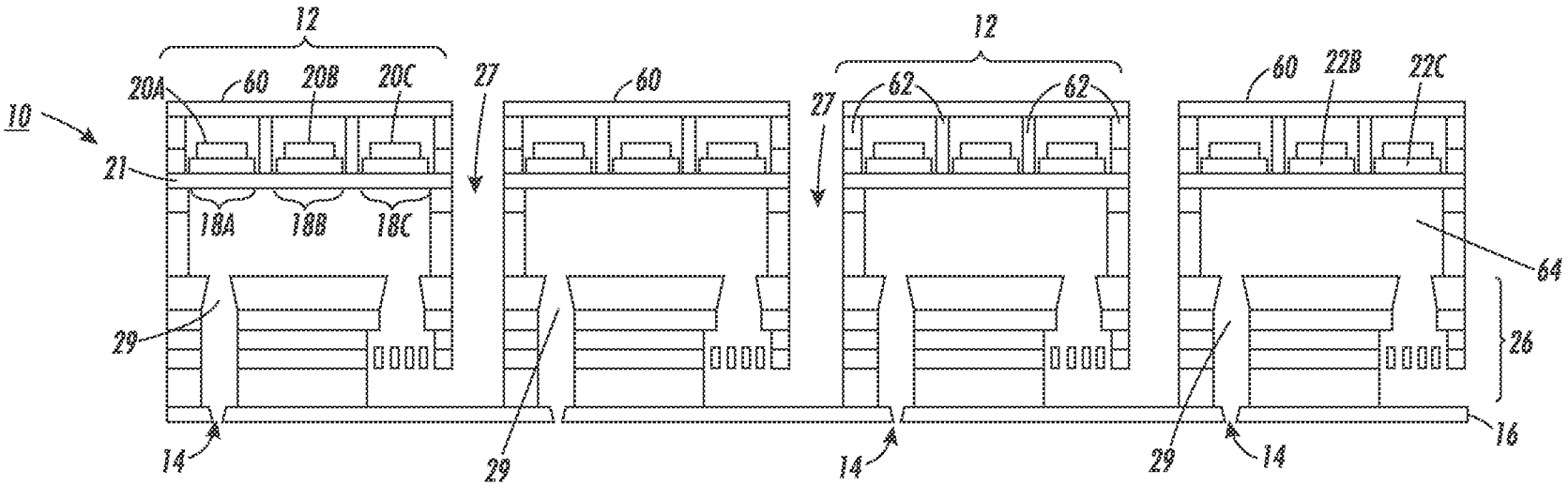

FIG. 6 depicts an embodiment of a piezoelectric actuator system array including one or more capping structures 60 that overlie the diaphragms 18 and the top electrode portions 20, and support nodes 62 that are interposed between the diaphragm layer 21 and the capping structures 60. As depicted, at least one of the nodes 62 is directly interposed in a lateral direction between each adjacent top electrode portion 20. This is in contrast to the embodiments of FIGS. 2 and 5 in which a portion of the nodes are formed within the body chamber. In the FIG. 6 embodiment, the body chamber 64 is open and no portion of the nodes 62 between adjacent top electrode portions 20 reside within the body chamber 64. This may improve the flow of ink between the ink inlet 27 and the ink outlet 29. In this embodiment, the interconnects 30 (FIG. 1) may be attached at ends of the top plate portions 20 that remain uncovered and exposed by the capping structures 60. In this embodiment, an actuator system may have the FIG. 6 body chamber 64 cross section at every body chamber location. In this embodiment, the diaphragms 18 for a single actuator system may be only partially decoupled, such that firing one of the top electrodes may deflect its paired diaphragm at a full amplitude, and may deflect other non-paired diaphragms at an incomplete amplitude. As described above, in another embodiment, an actuator system array may have the FIG. 6 cross section at a first location and the FIG. 2 cross section at a second location.

Figure 7:
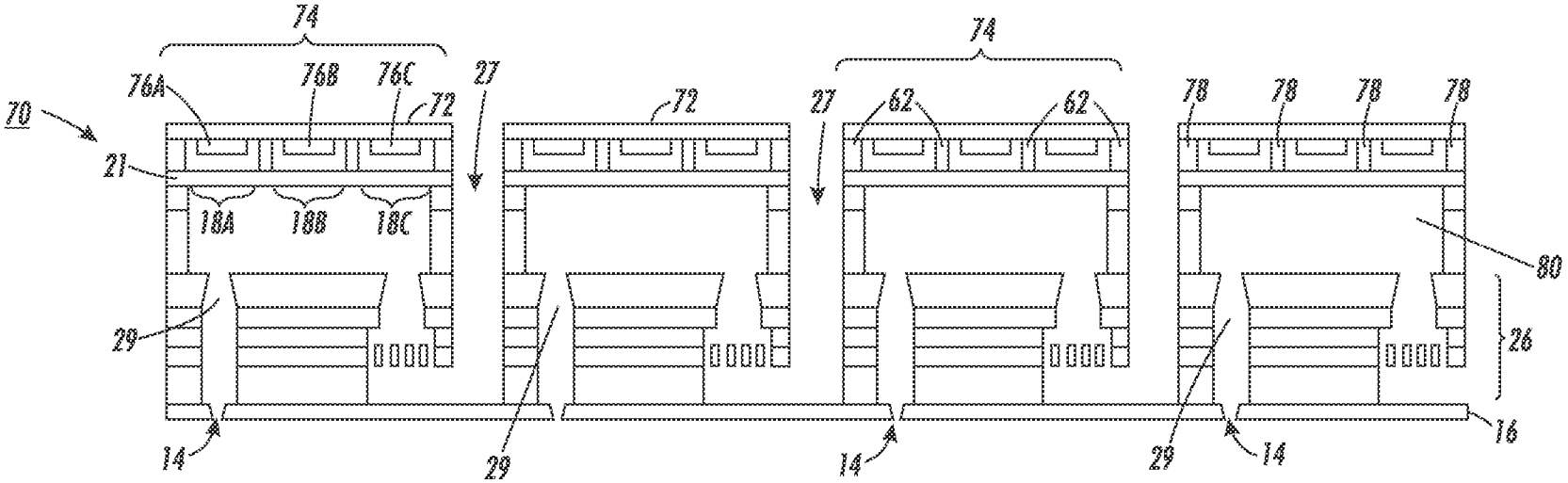

Various implementations may further be adapted for use with electrostatic actuator system printheads rather than the piezoelectric actuator system printheads depicted herein and described above for illustration. For example, FIG. 7 is a cross section depicting a portion of an electrostatic actuator system array 70. This embodiment includes a substrate 72 and a plurality of electrostatic actuator systems 74 formed as part of an actuator system array. Each actuator system 74 includes a plurality of spaced drive electrodes 76A-76C, a plurality of diaphragms 18A-18C, and a plurality of nodes 78 that define the plurality of diaphragms 18A-18C and separate a diaphragm layer 21 into the plurality of diaphragms 18. Each actuator system 74 may further include a body chamber 80 free of nodes 78 formed therein which may improve the flow of ink between the ink inlet 27 and the ink outlet 29, and may allow for reduced pressures within the printhead. In another embodiment, each the electrostatic actuator system may further include nodes within the body chamber 80, for example similar to nodes 24 (FIG. 2) that extend from, and physically contact, the diaphragm layer 21 at an upper end and a lower structure at a lower end, or nodes 50 (FIG. 5) that extend from, and physically contact, the diaphragm layer 21 at an upper end, but are unsupported at a lower end as depicted. The plurality of drive electrodes 76 are spaced from the plurality of diaphragms 18 by an actuator air chamber defined in part by the substrate 72 and the diaphragm layer 21. The actuator system air chamber allows the diaphragm 18 to deflect toward the drive electrode 76 during printing.

Upon activation of one or more of the electrodes 76 by the application of a voltage thereto, the diaphragm 18 paired with the activated electrode 76 is drawn toward the activated electrode 76 into a flexed state. This decreases the pressure within the body chamber 80 and draws ink into the body chamber through the ink inlet 27. Subsequently, the voltage is removed from the electrode 76 to deactivate the electrode 76, which releases the diaphragm 18 into a relaxed state, increases pressure within the body chamber 80, and ejects ink from the nozzle 14.

Embodiments of the electrostatic actuator system array 70 may include interconnects 30 such as those depicted in FIG. 1 that simultaneously fire every electrode 76 in the activated actuator system 74. Embodiments of the electrostatic actuator system array 70 may further include interconnects 40 such as those depicted in FIG. 4 that allow each electrode 76 in the actuator system 74 to be individually addressed, such that each diaphragm 18 may be individually addressed and activated.

Thus embodiments of the present teachings may allow for the formation of an actuator system array, wherein each actuator system has a low aspect ratio body chamber (from 1.0 to 2.0, or from 1.0 to 1.5), wherein each actuator system includes a thin film diaphragm. Each actuator system further includes a plurality (two or more, for example, three, four, five, or more) spaced electrode portions and a single ink ejection nozzle, wherein each electrode portion is uniquely paired with an individual diaphragm. The plurality of diaphragms for a single actuator system may be formed from a continuous diaphragm layer that is segmented into separate functional diaphragms by a plurality of nodes that physically contact the diaphragm layer. A point of maximum amplitude (maximum flexion) of the diaphragm may be at or near the center point between the two nodes that define the diaphragm. Activation one or more of the plurality of electrodes of a single actuator system causes deflection of the one or more of the plurality of diaphragms of the single actuator system, where each electrode is uniquely paired with one of the diaphragms. The printhead may be configured such that activating all electrodes for a single actuator system will eject ink from only one nozzle, wherein each actuator system is uniquely paired with only one nozzle.

Other variations are contemplated. It will be appreciated that an actuator system in accordance with an embodiment of the present teachings may include a plurality of diaphragms for each actuator system, wherein each diaphragm is addressable, either commonly or individually, by addressing and activating a bottom electrode of a plurality of bottom electrodes for each actuator system rather than the plurality of top electrodes as disclosed above. Thus in this system, a "drive electrode" refers to one of the plurality of bottom electrodes that drives actuation of one of the diaphragms of the actuator system. An actuator system array including a separate bottom electrode for each actuator system is disclosed in U.S. Pat. No. 7,048,361, commonly assigned herewith an incorporated herein by reference in its entirety. In addition to either top electrodes or bottom electrodes being the drive electrodes, other electrode configurations are contemplated.

Figure 8:
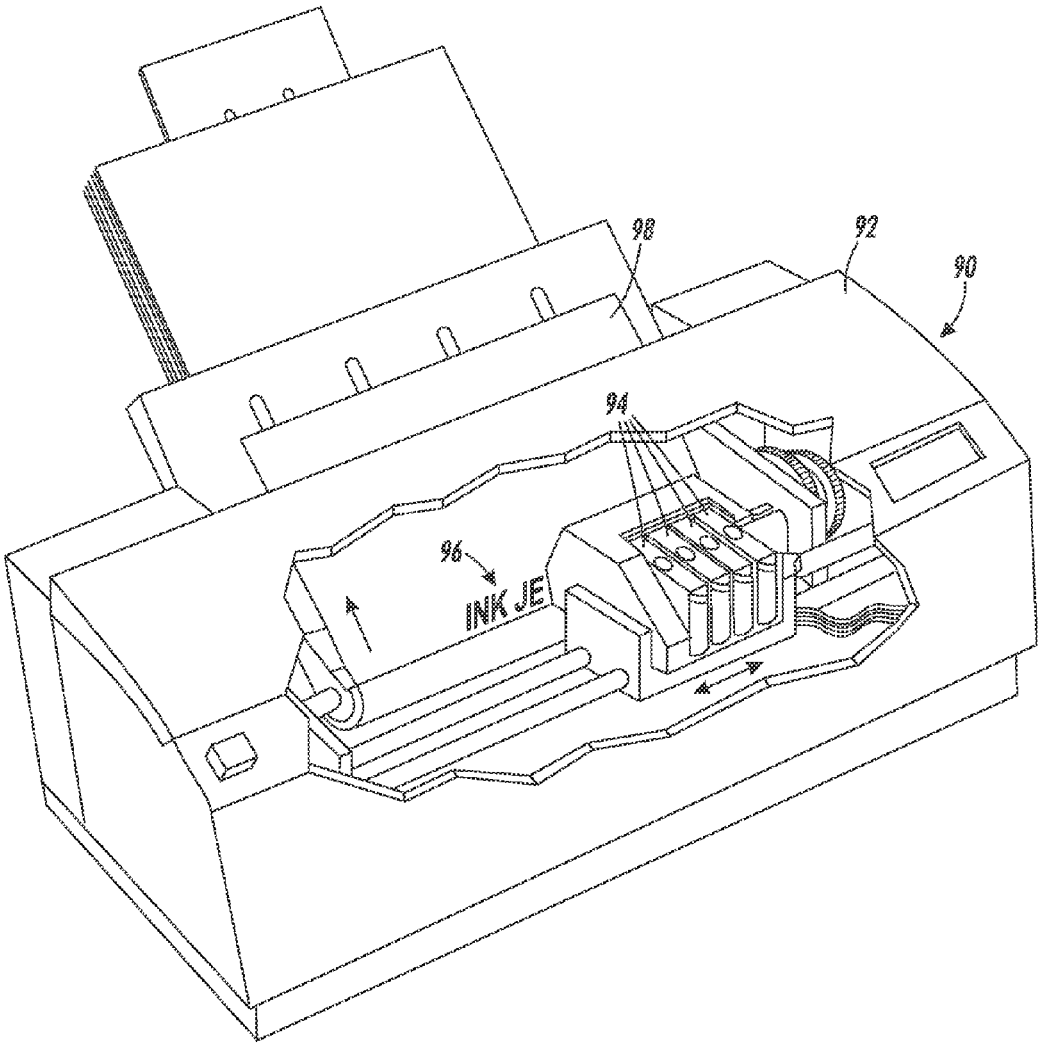
FIG. 8 is a perspective depiction of a printer including a printhead according to an embodiment of the present teachings.

FIG. 8 depicts a printer 90 including a printer housing 92 into which at least one printhead 94 including an embodiment of the present teachings has been installed. The housing 92 may encase the printhead 94. During operation, ink 96 is ejected from one or more printheads 94. The printhead 94 is operated in accordance with digital instructions to create a desired image on a print medium 98 such as a paper sheet, plastic, etc. The printhead 94 may move back and forth relative to the print medium 98 in a scanning motion to generate the printed image swath by swath. Alternately, the printhead 94 may be held fixed and the print medium 98 moved relative to it, creating an image as wide as the printhead 94 in a single pass. The printhead 94 can be narrower than, or as wide as, the print medium 98. In another embodiment, the printhead 94 can print to an intermediate surface such as a rotating drum or belt (not depicted for simplicity) for subsequent transfer to a print medium.

Notwithstanding that the numerical ranges and parameters setting forth the broad scope of the present teachings are approximations. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead comprising a plurality of actuator systems, wherein each actuator system comprises:

a plurality of laterally spaced drive electrodes, wherein each drive electrode is laterally spaced and electrically isolated from an adjacent drive electrode by a gap;

a plurality of diaphragms, wherein each drive electrode of the plurality of laterally spaced drive electrodes is uniquely paired with one diaphragm of the plurality of diaphragms;

a body chamber partially defined by the plurality of diaphragms and a plurality of nodes within the body chamber that physically contact the plurality of diaphragms, wherein the body chamber is configured to be filled with ink during printing; and an aperture plate comprising a plurality of nozzles, wherein:

the plurality of diaphragms and the plurality of laterally spaced drive electrodes are configured to eject ink through only one nozzle of the plurality of nozzles; and the plurality of laterally spaced drive electrodes are laterally spaced in a direction parallel with a major surface of the aperture plate.

2. The printhead of claim 1 wherein, in plan view, each body chamber further comprises:

a length dimension; and a width dimension, wherein at least one of the length dimension divided by the width dimension and the width dimension divided by the length dimension is between 1.0 and 2.0.

3. The printhead of claim 2, further comprising a continuous diaphragm layer that forms the plurality of diaphragms, wherein the diaphragm layer has a thickness of between about 1.0 μm and about 10.0 μm.

4. The printhead of claim 1, wherein each laterally spaced drive electrode of each of the plurality of actuator systems is individually addressable.

5. The printhead of claim 1, wherein the plurality of nodes within the body chamber is a first plurality of nodes, and each actuator system further comprises:

a continuous diaphragm layer that forms the plurality of diaphragms;

a second plurality of nodes that physically contact the continuous diaphragm layer, wherein one node of the second plurality of nodes is laterally interposed between each of the plurality of spaced drive electrodes;

an ink inlet in fluid communication with the body chamber; and and ink outlet in fluid communication with the ink inlet and the nozzle.

6. The printhead of claim 1, wherein each actuator system comprises a piezoelectric actuator and each piezoelectric actuator further comprises a plurality of spaced piezoelectric portions, wherein one of the piezoelectric portions is interposed between each drive electrode and the diaphragm uniquely paired with the drive electrode.

7. The printhead of claim 1, wherein;

each actuator comprises an electrostatic actuator;

each electrostatic actuator system further comprises a substrate overlying the plurality of diaphragms;

each of the plurality of drive electrodes is formed on the substrate; and each drive electrode is separated from its paired diaphragm by an actuator system air chamber such that the diaphragm is configured to deflect toward its paired drive electrode during printing.

8. The printhead of claim 1, wherein each drive electrode is individually addressable and the printhead is configured to:

selectively deflect a first number of diaphragms of the plurality of diaphragms to eject a first ink drop having at least one of a first volume and a first velocity from the nozzle; and selectively deflect a second number of diaphragms of the plurality of diaphragms, wherein the second number is larger than the first number, to eject a second ink drop having at least one of a second volume and a second velocity, wherein the second volume is greater than the first volume and the second velocity is greater than the first velocity.

9. The printhead of claim 1, further comprising:

a continuous diaphragm layer that forms the plurality of diaphragms;

a first end of each of the plurality of nodes within the body chamber that physically contacts the diaphragm; and a second end of each of the plurality of nodes that physically contacts a lower printhead layer.

10. The printhead of claim 1, further comprising:

a continuous diaphragm layer that forms the plurality of diaphragms;

a first end of each of the plurality of nodes within the body chamber that physically contacts the diaphragm; and a second end of each of the plurality of nodes that is unsupported by a lower printhead layer.

11. A printer, comprising:

at least one printhead comprising a plurality of actuator systems, wherein each actuator system comprises:

a plurality of laterally spaced drive electrodes, wherein each drive electrode is laterally spaced and electrically isolated from an adjacent drive electrode by a gap;

a plurality of diaphragms, wherein each drive electrode of the plurality of laterally spaced drive electrodes is uniquely paired with one diaphragm of the plurality of diaphragms;

a body chamber partially defined by the plurality of diaphragms and a plurality of nodes within the body chamber that physically contact the plurality of diaphragms, wherein the body chamber is configured to be filled with ink during printing; and an aperture plate comprising a plurality of nozzles, wherein:

the plurality of diaphragms and the plurality of laterally spaced drive electrodes are configured to eject ink through only one nozzle of the plurality of nozzles; and the plurality of laterally spaced drive electrodes are laterally spaced in a direction parallel with a major surface of the aperture plate; and a printer housing that encases the printhead.

12. The printer of claim 11 wherein, in plan view, each body chamber further comprises:

a length dimension; and a width dimension, wherein at least one of the length dimension divided by the width dimension and the width dimension divided by the length dimension is between 1.0 and 2.0.

13. The printer of claim 12, further comprising a continuous diaphragm layer that forms the plurality of diaphragms, wherein the diaphragm layer has a thickness of between about 1.0 μm and about 10.0 μm.

14. The printer of claim 11, wherein each laterally spaced drive electrode of each of the plurality of actuator systems is individually addressable.

15. The printer of claim 11, wherein the plurality of nodes within the body chamber is a first plurality of nodes, and each actuator system further comprises:

a continuous diaphragm layer that forms the plurality of diaphragms;

a second plurality of nodes that physically contact the continuous diaphragm layer, wherein one node of the second plurality of nodes is laterally interposed between each of the plurality of spaced drive electrodes;

an ink inlet in fluid communication with the body chamber; and and ink outlet in fluid communication with the ink inlet and the nozzle.

16. The printer of claim 11, wherein each actuator comprises a piezoelectric actuator and each piezoelectric actuator further comprises a plurality of spaced piezoelectric portions, wherein one of the piezoelectric portions is interposed between each drive electrode and the diaphragm uniquely paired with the drive electrode.

17. The printer of claim 11, wherein;

each actuator system comprises an electrostatic actuator;

each electrostatic actuator system further comprises a substrate overlying the plurality of diaphragms;

each of the plurality of drive electrodes is formed on the substrate; and each drive electrode is separated from its paired diaphragm by an actuator air chamber such that the diaphragm is configured to deflect toward its paired drive electrode during printing.

18. The printer of claim 11, wherein each drive electrode is individually addressable and the printhead is configured to:

selectively deflect a first number of diaphragms of the plurality of diaphragms to eject a first ink drop having at least one of a first volume and a first velocity from the nozzle; and selectively deflect a second number of diaphragms of the plurality of diaphragms, wherein the second number is larger than the first number, to eject a second ink drop having at least one of a second volume and a second velocity, wherein the second volume is greater than the first volume and the second velocity is greater than the first velocity.

19. The printer of claim 11, further comprising:

a continuous diaphragm layer that forms the plurality of diaphragms;

a first end of each of the plurality of nodes within the body chamber that physically contacts the diaphragm; and a second end of each of the plurality of nodes that physically contacts a lower printhead layer.

20. A method for printing ink, comprising:

activating a first drive electrode of a first actuator system that is part of an actuator system array to deflect a first diaphragm that is uniquely paired with the actuator system first drive electrode to eject a first ink drop having at least one of a first volume, a first velocity, and a first directionality from a nozzle in an aperture plate, while a second drive electrode of the first actuator system remains deactivated; and activating the second drive electrode of the first actuator system to deflect a second diaphragm that is uniquely paired with the actuator system second drive electrode and simultaneously activating the first drive electrode to eject a second ink drop having at least one of a second volume, a second velocity, and a second directionality from the nozzle in the aperture plate, wherein;

the at least one of the second volume, the second velocity, and the second directionality is different from the at least one of the first volume, the first velocity, and the first directionality; and the first drive electrode is laterally spaced and electrically isolated from the second drive electrode by a gap in a direction parallel with a major surface of the aperture plate.

* * * * *